US007984622B2

(12) United States Patent
Yoon et al.

(10) Patent No.: US 7,984,622 B2
(45) Date of Patent: Jul. 26, 2011

(54) ICEMAKER AND REFRIGERATOR HAVING THE SAME

(75) Inventors: Won Jae Yoon, Seoul (KR); Kook Jeong Seo, Osan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/909,467

(22) Filed: Oct. 21, 2010

(65) Prior Publication Data

US 2011/0023520 A1 Feb. 3, 2011

Related U.S. Application Data

(63) Continuation of application No. 12/588,500, filed on Oct. 16, 2009.

(30) Foreign Application Priority Data

Feb. 12, 2009 (KR) ..... 10-2009-0011405

(51) Int. Cl.
*F25C 5/18* (2006.01)
*F25C 1/12* (2006.01)
*F25C 1/22* (2006.01)

(52) U.S. Cl. ..... 62/344; 62/320; 62/340

(58) Field of Classification Search ..... 62/73, 137, 62/344, 353, 3.63, 340, 381
See application file for complete search history.

(56) References Cited

U.S. PATENT DOCUMENTS

| | | | | |
|---|---|---|---|---|
| 2,729,070 | A | 1/1956 | Ames | |
| 3,747,810 | A | 7/1973 | Graser | |
| 3,913,349 | A | 10/1975 | Johnson | |
| 4,474,023 | A | 10/1984 | Mullins, Jr. | |
| 4,966,015 | A | 10/1990 | Wessa | |
| 6,062,036 | A | 5/2000 | Hobelsberger | |
| 6,122,927 | A * | 9/2000 | Moore | 62/347 |
| 6,453,696 | B1 | 9/2002 | Kawasumi et al. | |
| 6,763,675 | B1 | 7/2004 | Fleeman | |
| 6,964,177 | B2 * | 11/2005 | Lee et al. | 62/320 |
| 6,964,351 | B2 * | 11/2005 | Jablonski et al. | 222/146.6 |
| 7,210,307 | B2 | 5/2007 | Kuehl et al. | |
| 7,266,951 | B2 | 9/2007 | Anselmino et al. | |
| 2006/0065007 | A1 * | 3/2006 | Park et al. | 62/344 |
| 2007/0119202 | A1 * | 5/2007 | Kadowaki et al. | 62/340 |
| 2008/0156023 | A1 * | 7/2008 | Kim et al. | 62/344 |

FOREIGN PATENT DOCUMENTS

JP 2004340517 A 12/2004

OTHER PUBLICATIONS

"Portable Ice Maker", published May 25, 2007; retrieved on Oct. 11, 2010 from: http://www.slashgear.com/portable-ice-maker-great-for-outdoor-parties-255433/.

U.S. Appl. No. 12/588,500, filed Oct. 16, 2000, Won Jae Yoon Samsung Electronics Co., Ltd.

* cited by examiner

*Primary Examiner* — Frantz Jules
*Assistant Examiner* — Emmanuel Duke
(74) *Attorney, Agent, or Firm* — Staas & Halsey LLP

(57) ABSTRACT

Disclosed herein is an icemaker of a refrigerator including an ice dispersing unit to disperse ice for uniform distribution of ice in an ice making container. The icemaker includes an ice making unit to make ice, and an ice making container to receive ice separated from the ice making unit. The icemaker further includes an ice dispersing unit arranged between the ice making unit and the ice making container. The ice dispersing unit serves to guide the ice moving from the ice making unit to the ice making container, to assure uniform distribution of the ice in the ice making container.

20 Claims, 8 Drawing Sheets

ICEMAKER AND REFRIGERATOR HAVING THE SAME

CROSS-REFERENCE TO RELATED APPLICATIONS

This application is a continuation of U.S. Ser. No. 12/588,500, filed Oct. 16, 2009, now pending, which claims the benefit of Korean Patent Application No. 2009-0011405, filed on Feb. 12, 2009 in the Korean Intellectual Property Office, the disclosure of which is incorporated herein by reference.

BACKGROUND

1. Field

Embodiments of the present invention relate to an icemaker of a refrigerator including an ice dispersing unit to disperse ice for uniform distribution of ice in an ice making container.

2. Description of the Related Art

Generally, a refrigerator includes, e.g., a refrigerating compartment for refrigeration of beverages and food, and a freezing compartment for freezing of beverages and food.

The freezing compartment is provided with an icemaker. The icemaker serves to freeze water received in the freezing compartment into ice.

The icemaker takes the form of a box configured to receive water therein and having an open upper side to assure easy discharge of ice. To allow a user to select a size of ice, a plurality of latticed partitions is arranged in the icemaker.

In operation, water is injected into spaces defined by the latticed partitions of the icemaker through the open upper side of the icemaker, and the icemaker containing the water is preserved in the freezing compartment for a desired time. Once the water received in the icemaker is frozen into ice, the icemaker is inverted to discharge the ice through the open upper side of the icemaker.

Recently, an automatic or semiautomatic icemaker has been developed, wherein supply and freezing of water as well as discharge of ice to a user are implemented under the control of a refrigerator.

The automatic or semiautomatic icemaker includes a water supply device to supply water from an external source into a refrigerator, an icemaker to receive the water supplied from the water supply device, and an ice storage container.

In the automatic or semiautomatic icemaker, water is supplied from the water supply device into the icemaker under the control of a refrigerator, or by manual operation of a user, and the supplied water is received and frozen in the icemaker mounted in a freezing compartment. The frozen ice is separated from the icemaker by a delivery device of the icemaker and in turn, the separated ice is accumulated in the ice storage container arranged under the icemaker to be used based on a user's selection.

However, when the ice is accumulated in the storage container, the ice may be concentrated on a lower end of the storage container. This prevents efficient utilization of the entire storage container and moreover, accumulation of the ice in a specific region may lead to erroneous detection of an ice-full state.

SUMMARY

Therefore, it is an aspect of the present invention to provide an icemaker including an ice dispersing unit to disperse ice for uniform distribution of ice in an ice making container.

Additional aspects of the invention will be set forth in part in the description which follows and, in part, will be apparent from the description, or may be learned by practice of the invention.

The foregoing and/or other aspects of the present invention are achieved by providing an icemaker including an ice making unit to make ice, an ice making container to receive the ice from the ice making unit, and an ice dispersing unit arranged between the ice making unit and the ice making container and to guide the ice moving from the ice making unit to the ice making container, to assure uniform distribution of the ice in the ice making container.

The ice dispersing unit may be tilted downwards and towards one side of the ice making container.

The ice dispersing unit may include a plate-shaped guide member, and the guide member may have one end fixed to a wall of the ice making container and the other end extending opposite to the wall of the ice making container.

The guide member may have one end fixed to a rear surface of the ice making container and the other end extending forward of the ice making container. A cross section of the guide member may have a curvature. The guide member may include an ice guide opening for passage of the ice. The guide member may further include a plurality of guidelines. The guidelines may be arranged radially to have different directions. The guidelines may have different lengths from one another.

The foregoing and/or other aspects of the present invention may be achieved by providing an icemaker, including an ice making unit to freeze water into ice and an ice making container to receive the ice from the ice making unit; and an ice dispersing unit to disperse the ice falling from the ice making unit into the ice making container, to assure uniform distribution of the ice in the ice making container, and the ice dispersing unit includes a plate-shaped guide member arranged between the ice making unit and the ice making container and tilted downwards and towards a front of the ice making container.

The foregoing and/or other aspects of the present invention may be achieved by providing an icemaker, including an ice making unit to freeze water into ice; an ice making container to receive the ice from the ice making unit; an ice dispersing unit to uniformly disperse the ice falling from the ice making unit into the ice making container using a plate-shaped guide member, and the guide member includes a plurality of guidelines arranged radially to have different directions.

The foregoing and/or other aspects of the present invention may be achieved by a refrigerator including a body having a storage compartment and an icemaker provided in the storage compartment; wherein the icemaker includes an ice making unit to freeze water into ice and an ice making container to receive the ice from the ice making unit, and the icemaker further includes an ice dispersing unit for guidance of the ice between the ice making unit and the ice making container, the ice dispersing unit to disperse the ice falling from the ice making unit into the ice making container, to assure uniform distribution of the ice in the ice making container.

The ice dispersing unit may be located closer to one side of the ice making unit.

The ice dispersing unit may include a fixing member configured to be fixable to the body, and a plate-shaped guide member connected to the fixing member and to guide the ice falling from the ice making unit.

The guide member may be tilted downwards and towards a front of the ice making container.

The fixing member may be formed of a wire. The fixing member may be made of an elastic material. The guide member may include a plurality of guidelines. The guidelines may be arranged radially to have different directions. The guidelines may have different lengths from one another.

The foregoing and/or other aspects may be achieved by a refrigerator including a body defining an external appearance of the refrigerator; a storage compartment formed in the body and having an open side; a door to open and close the open side of the storage compartment; an ice making unit provided in the storage compartment, the ice making unit including an ice making tray having cavities to receive water therein, the water in the ice making tray being frozen into ice pieces by cold air; an ice container to receive the ice pieces; and a guide member to guide the ice pieces, after being separated from the ice making tray, into the ice container, the guide member having a longitudinal side portion located adjacent to the ice making unit and a curved guide portion to enable the separated ice pieces to slide along the curved guide portion and fall into the ice container, wherein the guide member is configured such that a first one of the ice pieces, separated from a first one of the cavities, and slide along the curved guide portion, travels a distance that is different from a distance traveled by a second one of the ice pieces separated from a second one of the cavities of the ice making tray.

The guide member may be configured such that the first one of the ice pieces travels along a first path of the curved guide portion that has a slope different from a slope of a second path traveled by the second one of the ice pieces.

The foregoing and/or other aspects may be achieved by a refrigerator including a body defining an external appearance of the refrigerator; a storage compartment formed in the body and having an open side; a door to open and close the open side of the storage compartment; an ice making unit provided in the storage compartment, the ice making unit including an ice making tray having cavities to receive water therein, the water in the ice making tray being frozen into ice pieces by cold air; an ice container to receive the ice pieces; and a guide member to guide the ice pieces, after being separated from the ice making tray, into the ice container, the guide member having: a longitudinal side portion located adjacent to the ice making tray, a free side portion, and a curved guide portion between the longitudinal side portion and the free side portion, the longitudinal side portion being higher than the free side portion such that the separated ice pieces slide along the curved guide portion and fall into the ice container, wherein the guide member is configured such that a first one of the ice pieces, separated from a first one of the cavities of the ice making tray, travels along a first path of the curved guide portion, the first path having a slope different from a slope of a second path of the curved guide portion traveled by a second one of the ice pieces separated from a second one of the cavities of the ice making tray.

The guide member may further include a plurality of guide lines defining the first path and the second path so that the first and second paths have different travel lengths and directions.

The foregoing and/or other aspects may be achieved by a refrigerator including a body defining an external appearance of the refrigerator; a storage compartment formed in the body and having an open side; a door to open and close the open side of the storage compartment; an ice making unit provided in the storage compartment, the ice making unit including an ice making tray having cavities to receive water therein, the water in the ice making tray being frozen into ice pieces by cold air; an ice container to receive the ice pieces; and a guide member arranged between the ice making unit and the ice container, the guide member including a mounting portion, a free end portion and a sloped portion between the mounting portion and the free end portion, wherein the sloped portion is sloped in both a longitudinal direction and a lateral direction of the ice making tray.

The guide member may further have a curved guide surface.

The guide member may have a plurality of travel paths for the ice pieces separated from respective cavities of the ice making tray, each of the travel paths having a slope different from a slope of the other travel paths.

The guide member may be configured to provide a travel path along the sloped portion to enable one of the ice pieces from the ice making unit to move in a diagonal direction with respect to the ice making tray.

The guide member may be located adjacent to one side of the ice making unit to transfer the ice separated from the ice making unit into the ice container.

At least a portion of the guide member may be tilted in a downward direction towards a front end thereof and is further tilted in a downward direction towards an outer end thereof.

The portion of the guide member may be tilted in the downward direction towards the front end thereof by a predetermined angle $\theta_1$, and is also tilted downwards and towards an outer end thereof by a predetermined angle $\theta_2$.

At least a portion of the guide member may be tilted in a downward direction substantially perpendicular to the mounting portion and is further tilted in a downward direction substantially parallel to the mounting portion.

The mounting portion of the guide member may be located higher than a free end of the guide member such that the ice falling from the ice making unit may slide along the tilted guide member.

The guide member may have a plate form including an arched cross section suitable to smoothly guide the ice falling from the ice making unit into the ice container.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Hereinafter, a refrigerator according to an exemplary embodiment of the present invention will be described with reference to the accompanying drawings.

Figure 1:
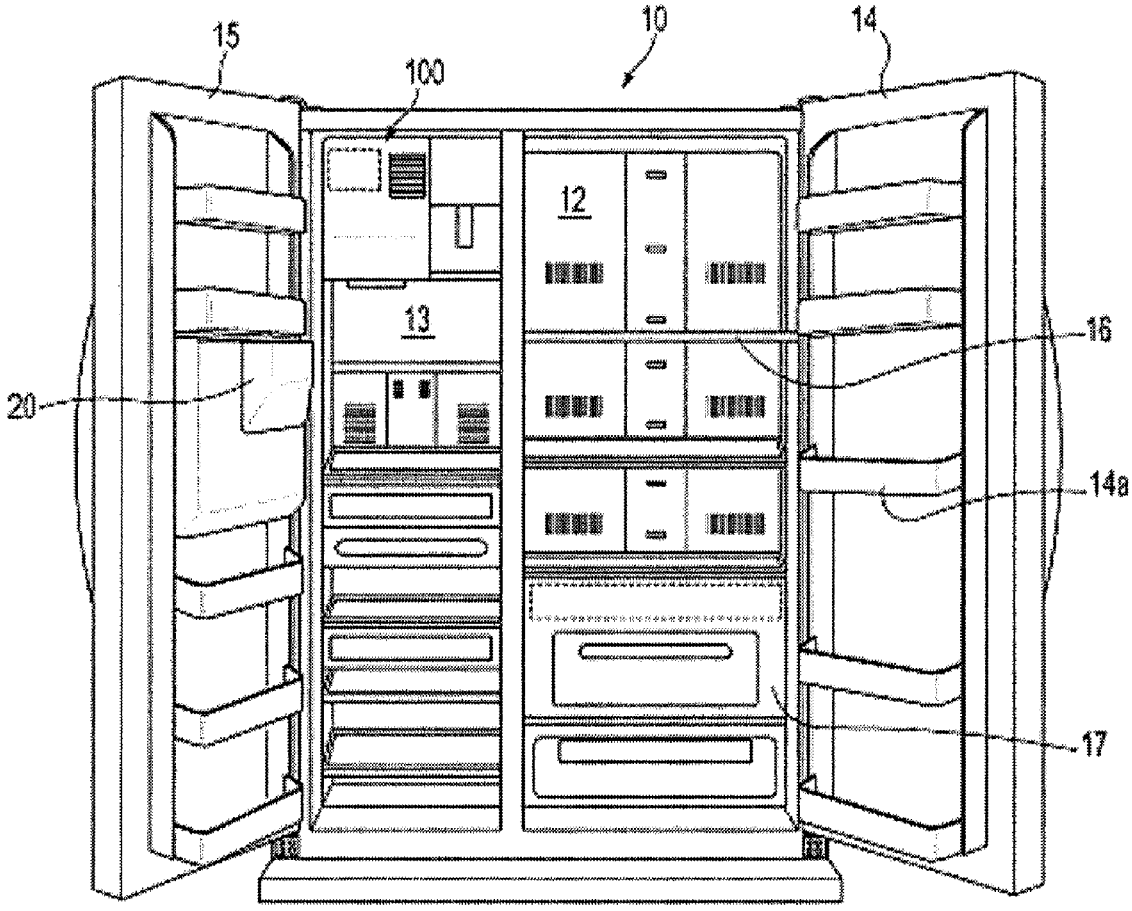
FIG. 1 is a perspective view schematically illustrating a refrigerator according to a first embodiment of the present invention.
Figure 2:
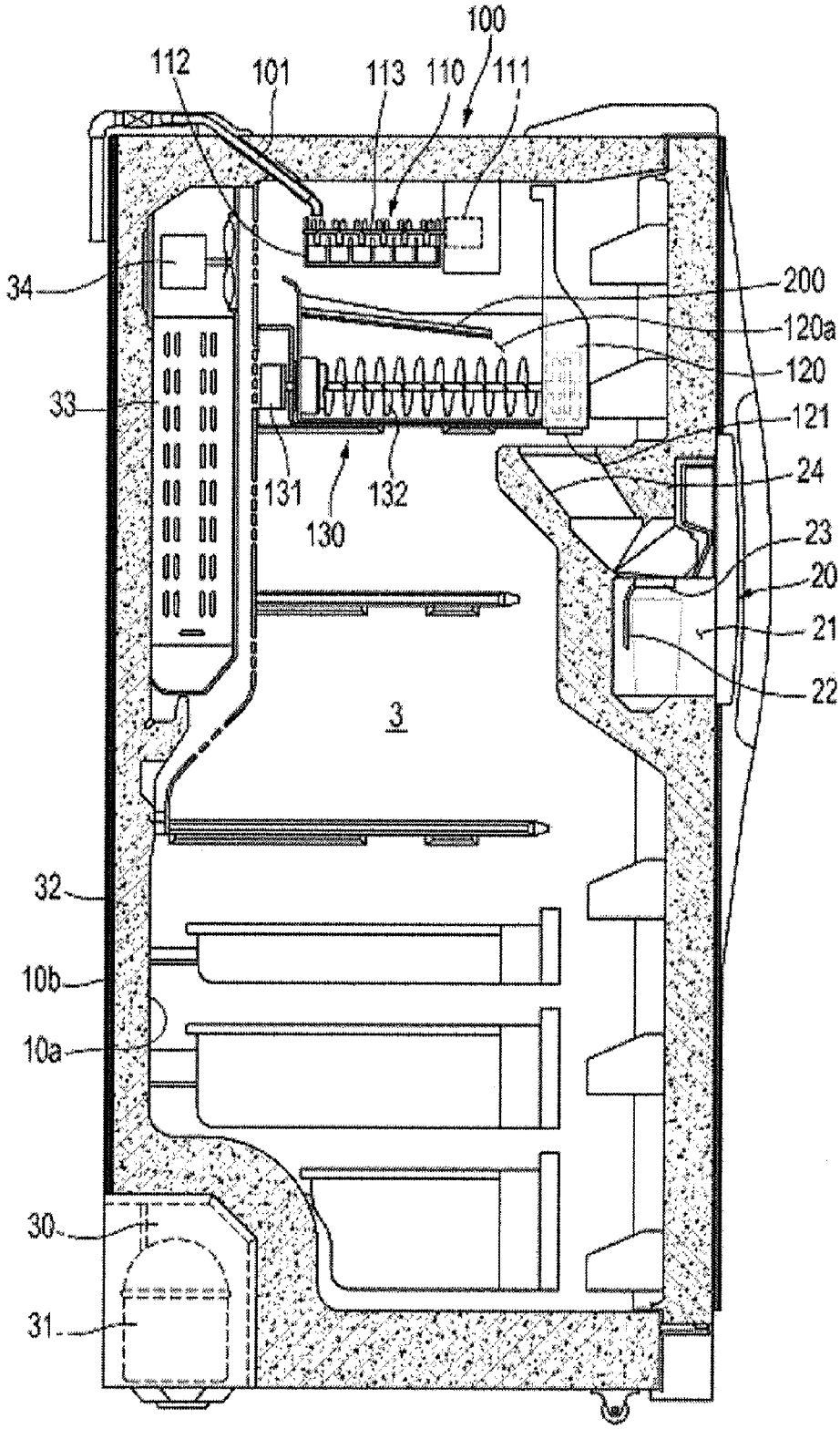
FIG. 2 is a side sectional view schematically illustrating an icemaker of the refrigerator according to the embodiment of FIG. 1.

As shown in FIGS. 1 and 2, the refrigerator according to the first embodiment of the present invention includes a body 10 defining an external appearance of the refrigerator, storage compartments 12 and 13 defined vertically lengthwise in the body 10 and having open front sides, doors 14 and 15 to open or close the open front sides of the storage compartments 12 and 13, an icemaker 100 provided in one of the storage compartments 12 and 13, i.e. a freezing compartment 13, and a dispenser 20 to discharge ice in the icemaker 100 to a front surface of the door 15 of the freezing compartment 13.

An evaporator 33 to produce cold air is provided at a rear wall of the body 10, and a machine room 30 is defined in a rear bottom region of the body 10. Electric elements including, e.g., a compressor 31 are received in the machine room 30.

For heat insulation, a foam material 32 is filled between an outer shell 10*b* and an inner shell 10*a* of the body 10.

Although not shown, the body 10 further contains various elements, such as, e.g., a condenser and an expander constituting a refrigeration cycle.

The storage compartments 12 and 13 are horizontally separated from each other by a partition. The refrigerating compartment 12 is located at the right side of the drawing and may preserve food in a refrigerated state, and the freezing compartment 13 is located at the left side of the drawing and may preserve food in a frozen state.

The evaporator 33 is located at the rear of the storage compartments 12 and 13 and implements heat exchange with surrounding air to produce cold air to be supplied into the storage compartments 12 and 13. A circulating fan 34 is provided to blow the heat-exchanged cold air having passed through the evaporator 33 into the storage compartments 12 and 13.

The storage compartments 12 and 13 contain shelves 16 and drawers 17 for food storage.

A pair of the doors 14 and 15 is provided to open or close the refrigerating compartment 12 and the freezing compartment 13, respectively. The doors 14 and 15 include a refrigerating compartment door 14 rotatably coupled to the body 10 to open or close the refrigerating compartment 12, and the freezing compartment door 15 rotatably coupled to the body 10 to open or close the freezing compartment 13.

A plurality of door baskets 14*a* for food storage is provided at inner surfaces of the refrigerating compartment door 14 and freezing compartment door 15.

The dispenser 20 is provided at the freezing compartment door 15, to allow a user to discharge a substance, such as water or ice, without opening the door 15. The icemaker 100 is provided in a top space of the freezing compartment 13 and serves to supply ice to the dispenser 20.

The dispenser 20 includes a discharge chamber 21 indented inward from the front surface of the freezing compartment door 15, an opening/closing member 23 to open or close the discharge chamber 21 for discharge of a substance, an operating lever 22 provided in the discharge chamber 21 and serving not only to operate the opening/closing member 23 but also to operate the icemaker 100 provided in the freezing compartment 13, and an ice discharge passage 24 extending from a rear surface to the front surface of the freezing compartment door 15 to guide ice from the icemaker 100 to the discharge chamber 21.

The icemaker 100 provided in the top space of the freezing compartment 13 includes an ice making unit 110 to make ice, and an ice making container 120 arranged under the ice making unit 110, in which ice made in the ice making unit 110 is stored.

The ice making unit 110 includes a metallic ice making tray 112 to freeze water supplied from an external source into ice, a scraper 113 to discharge the ice from the ice making tray 112, a drive motor 111 to operate the scraper 113, and a heater (not shown) to melt one side of ice in contact with the ice making tray 112 to assure smooth separation of ice by the scraper 113.

A water supply tube 101 is arranged at a rear surface of the body 10 and extends to the top of the ice making unit 110 thus serving to supply water, for use in ice making, into the ice making unit 110.

Although the present embodiment exemplifies the ice making unit 110 including the metallic ice making tray 112, scraper 113, drive motor 111 and heater, another configuration may be employed, wherein ice is discharged downward from an ice making tray as a resin injection molded article via sequential rotating and twisting motions of the ice making tray.

The ice making container 120 arranged under the ice making unit 110 takes the form of a drawer extending lengthwise from the front to the rear, the ice making container 120 having an open upper side to receive ice falling from the ice making unit 110.

The ice making container 120 includes a receiving chamber 120*a* defined therein, an ice discharge opening 121 perforated in a front bottom thereof to discharge ice into the ice discharge passage 24, and a delivery unit 130 to move the ice in the ice receiving chamber 120*a* to the ice discharge opening 121.

The delivery unit 130 includes a spiral delivery member 132 rotatably installed in the receiving chamber 120*a*, and a delivery motor 131 fixed to a rear surface of the ice making container 120 and used to rotate the spiral delivery member 132.

Accordingly, if a predetermined time passes after water is filled in the ice making tray 112 through the water supply tube 101, the water in the ice making tray 112 is frozen into ice by cold air circulating in the freezing compartment 13.

The ice falls into the ice making container 120 via operation of the heater (not shown) and the scraper 113.

In this case, if the user attempts to remove the ice via the dispenser 20, the delivery unit 130 is operated to discharge the ice from the ice making container 120 into the discharge chamber 21 through the ice discharge opening 121 and ice discharge passage 24. After the ice stored in the ice making container 120 is discharged, water is again supplied into the ice making tray 112 to thereby be frozen into ice. These ice making and discharge operations are implemented under the control of a controller (not shown) coupled to the icemaker 100.

In the case where the ice in the icemaker 100 is supplied to the user via the dispenser 20 with the above-described serial operations, in the conventional art, it would have been necessary to store a great amount of ice because of a limited ice production speed when it is desired to use a great amount of ice at once.

In addition, when the ice made in the ice making unit 110 falls into the ice making container 120, in the conventional art, the ice is mainly accumulated immediately under the ice making unit 110 because the ice making unit 110 is smaller than the ice making container 120. For example, if the ice making unit 110 is located above the rear of the ice making unit 120, the ice will be accumulated only in the rear of the ice making container 120, thus causing deteriorated space utilization of the entire ice making container 120.

Accordingly, to enhance utilization of the ice making container 120 and increase a storage amount of ice, an ice dispersing unit 200 is provided to disperse the ice falling from the ice making unit 110 for uniform distribution of the ice in the ice making container 120.

The ice dispersing unit 200 is arranged between the ice making unit 110 and the ice making container 120 and is tilted downwards and towards one side of the ice making container 120 to guide the ice into the ice making container 120.

Figure 3:
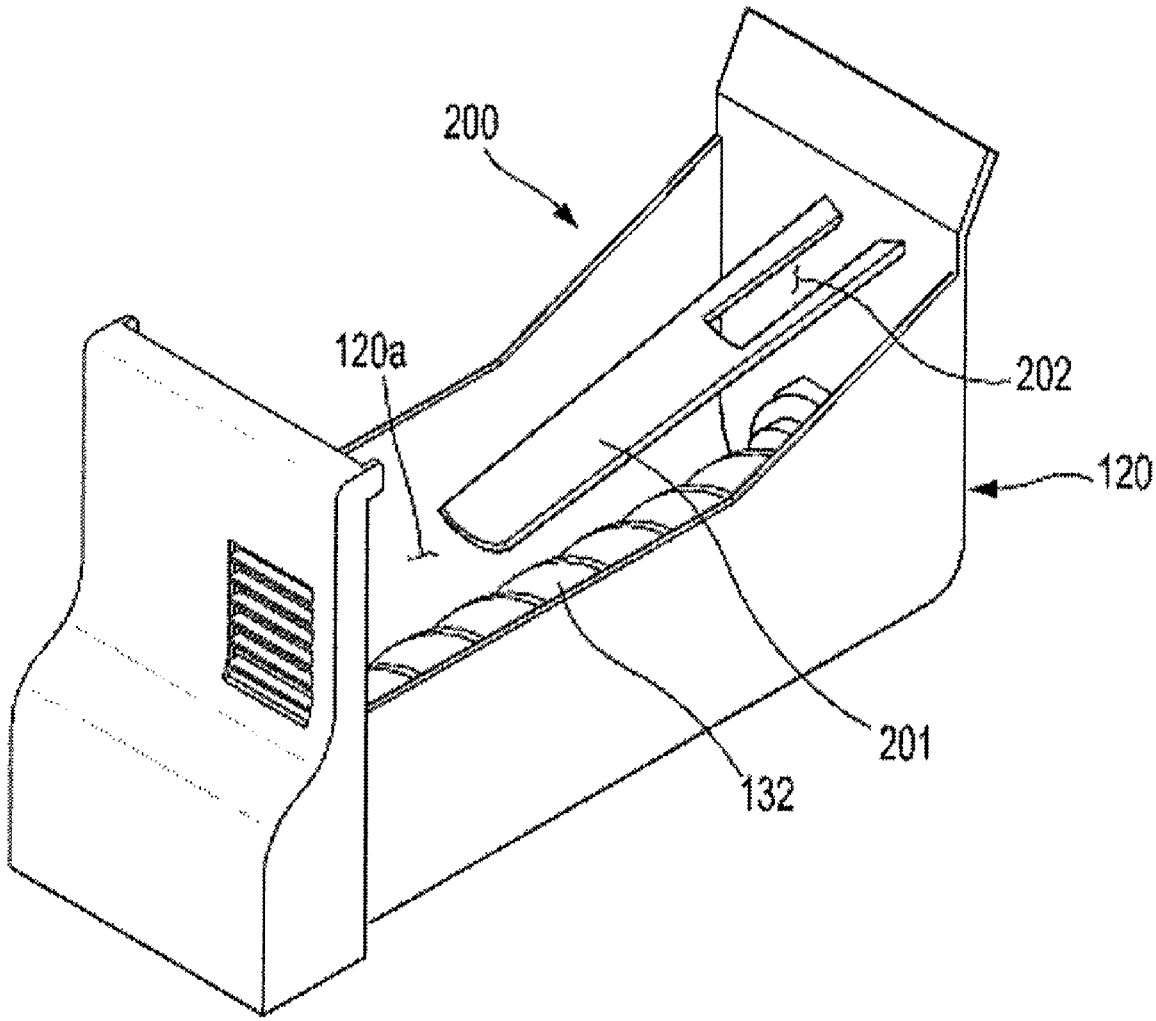
FIG. 3 is a perspective view schematically illustrating an ice dispersing unit of the icemaker according to the embodiment of FIG. 1.
Figure 4:
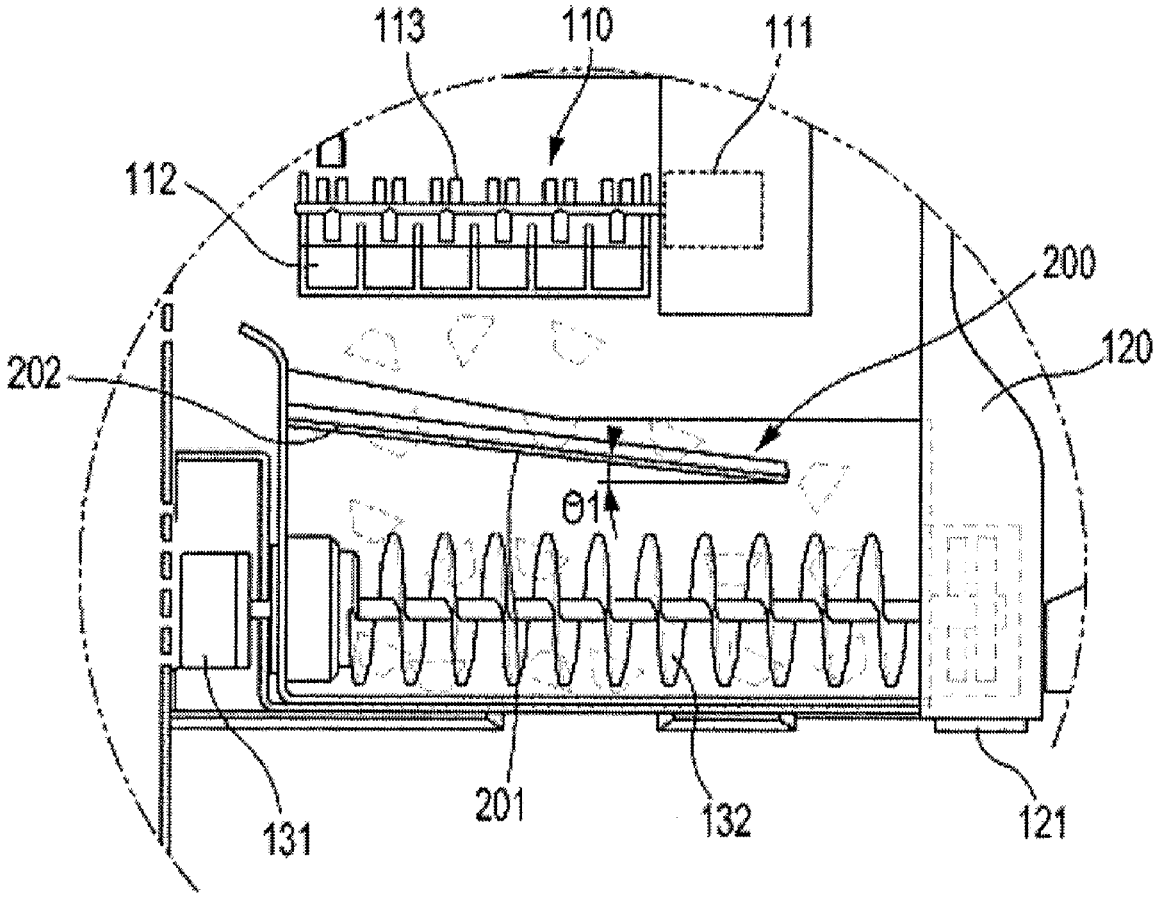
FIG. 4 is a side sectional view schematically illustrating the ice dispersing unit of the icemaker according to the embodiment of FIG. 1.

FIGS. 3 and 4 illustrate the icemaker 100 including the ice dispersing unit 200 according to the first embodiment of the present invention.

The ice dispersing unit 200 includes a guide member 201 to guide the ice falling from the ice making unit 110 into the ice making container 120, one end of the guide member 201 being fixed to a rear surface of the ice making container 120.

The fixed end of the guide member 201 is located higher than a free end of the guide member 201 such that the ice falling from the ice making unit 110 may slide along the tilted guide member 201.

Specifically, the guide member 201 has one end fixed to the rear surface of the ice making container 120, whereas the other end of the guide member 201 is positioned to provide the guide member 201 with a predetermined inclination $\theta_1$, thus causing the guide member 201 to be tilted downwards and towards the center of the ice making container 120.

The guide member 201 has a plate form and more particularly, an arched cross section suitable to smoothly guide the ice falling from the ice making unit 110 into the ice making container 120.

The guide member 201 extends lengthwise in a longitudinal direction of the ice making container 120, thus guiding the ice forward of the ice making container 120.

The guide member 201 has an ice guide opening 202 perforated in a rear center thereof by a predetermined width to allow the ice to be directly accumulated in the ice making container 120 through the guide member 201.

Of the ice falling from the ice making unit 110, a part of the ice may directly fall from the ice making unit 110 into the ice making container 120 through the ice guide opening 202, and the remaining part may be moved forward of the ice making container 120 along the guide member 201 of the ice dispersing unit 200.

Accordingly, a part of the ice falling from the ice making unit 110 may be received in a rear region of the ice making container 120, and the remaining ice may be received in a front region of the ice making container 120, resulting in uniform distribution of the ice in the front and rear regions of the ice making container 120.

Figure 5:
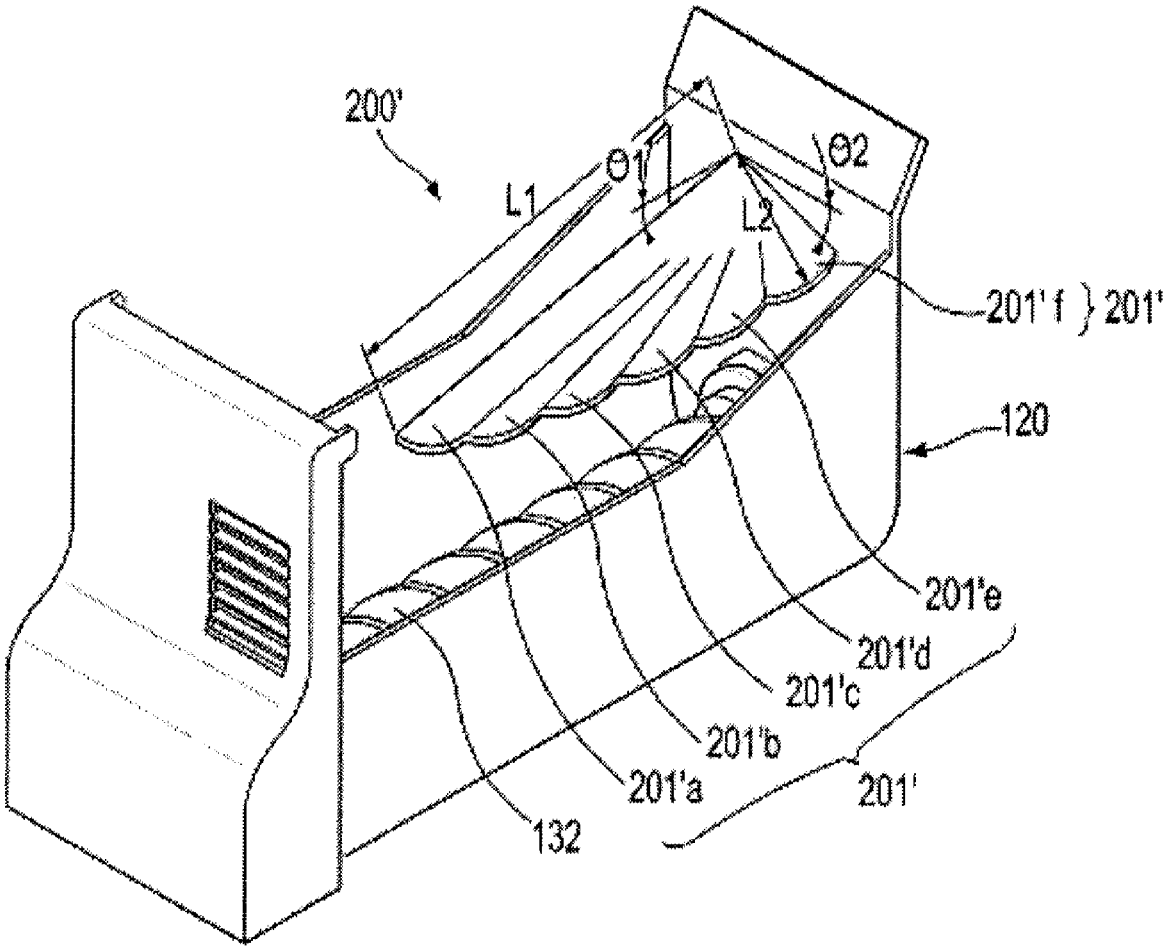
FIG. 5 is a perspective view schematically illustrating an ice dispersing unit according to a second embodiment of the present invention.

Referring to FIG. 5 illustrating a second embodiment of the present invention, an ice dispersing unit 200' of the icemaker 100 includes a plurality of guidelines 201' along which the ice falling from the ice making unit 110 may slide into the ice making container 120.

The guidelines 201' are arranged radially to have different lengths and directions.

Specifically, although a first guideline 201'*a* has the same longitudinal direction as the ice making container 120, a second guideline 201'*b* is positioned to the right of the first guideline 201'*a* and in turn, a third guideline 201'*c* is positioned to the light of the second guideline 201'*b*.

In this case, a rightmost sixth guideline 201'*f* has the same direction as a transversal direction of the ice making container 120.

Accordingly, the guidelines 201', which extend in different directions from one another, are arranged fanwise, allowing the ice falling from the ice making unit 110 to be dispersed to different regions of the ice making container 120.

In addition, the first guideline 201'*a* has a greater length $L_1$ than the second guideline 201'*b* located at the right side thereof, the second guideline 201'*b* is longer than the third guideline 201'*c* located at the right side thereof, and the third guideline 201'*c* is longer than a fourth guideline 201'*d* located at the right side thereof. Similarly, the fourth guideline 201'*d* is longer than a fifth guideline 201'*e*, and the fifth guideline 201'*e* has a greater length than a length $L_2$ of the sixth guideline 201'*f*.

The ice dispersing unit 200' including the guidelines 201' is tilted downwards and towards a front end thereof by a predetermined angle $\theta_1$, and is also tilted downwards and towards an outer end thereof by a predetermined angle $\theta_2$.

Accordingly, the ice falling from the ice making unit 110 is guided along the guidelines 201' located at different positions to be uniformly dispersed and received in the ice making container 120.

Figure 6:
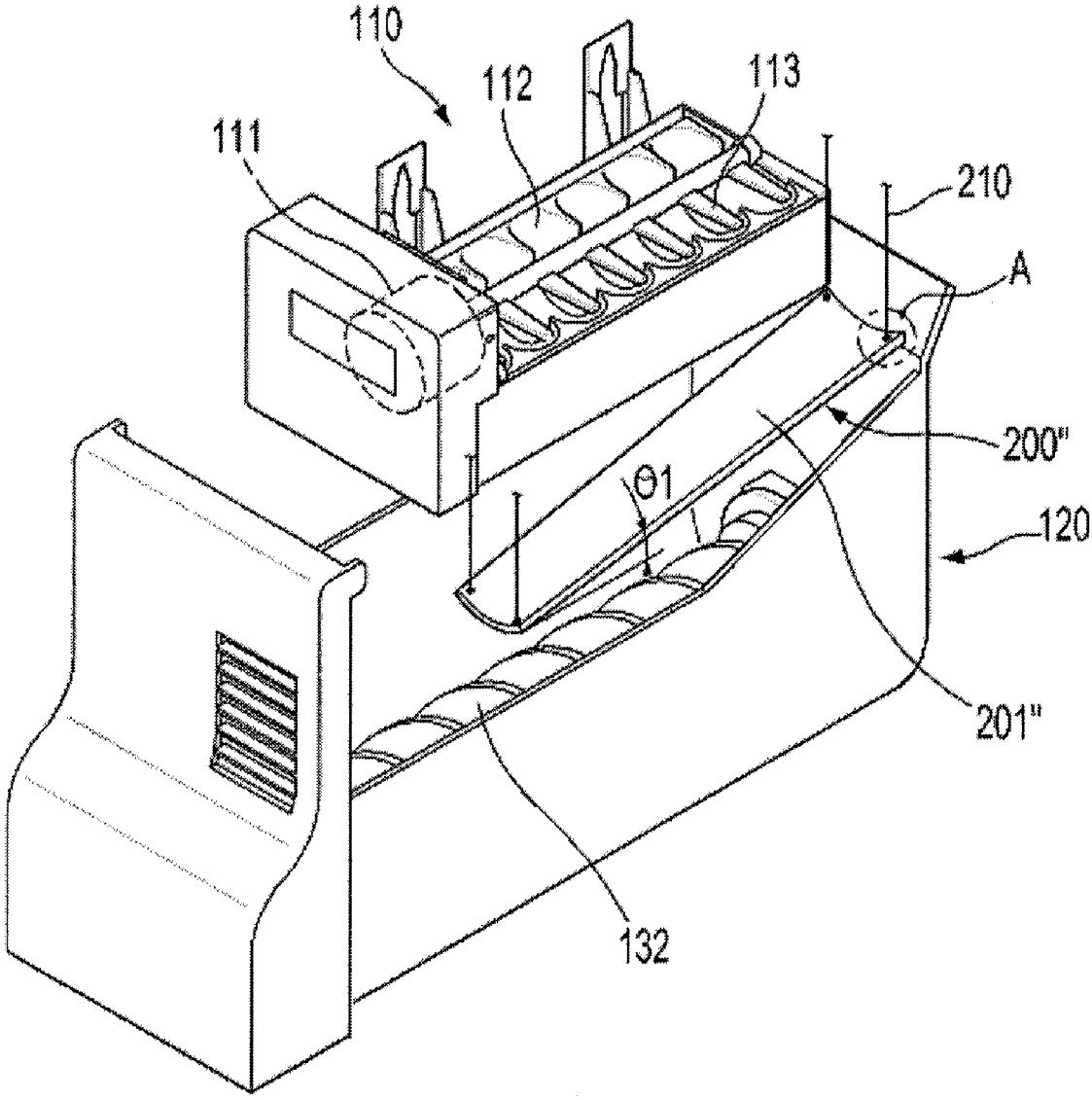
FIG. 6 is a perspective view schematically illustrating an ice dispersing unit according to a third embodiment of the present invention.
Figure 8:
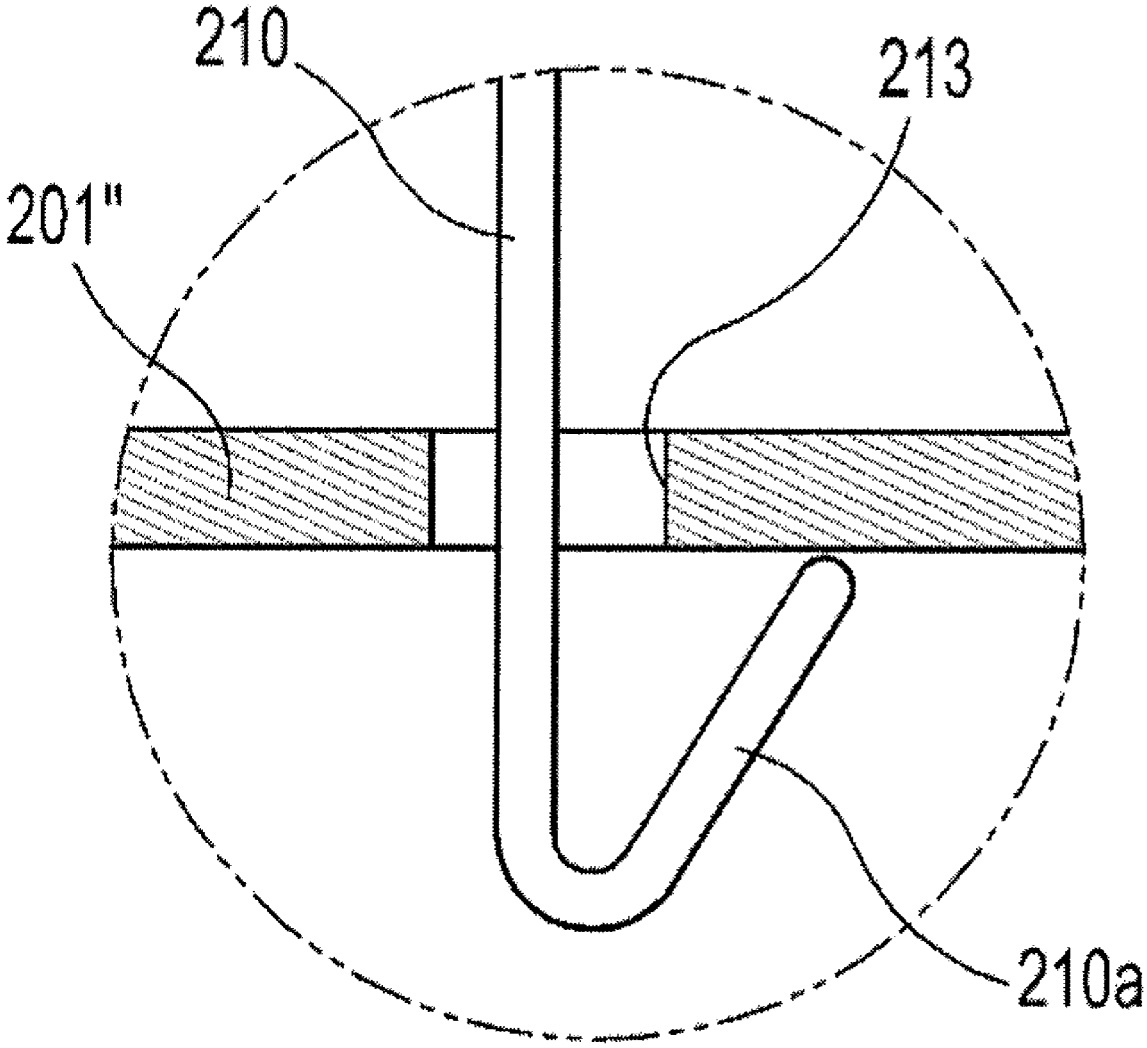
FIG. 8 is an enlarged view of the portion A in FIG. 6.

Referring to FIGS. 6 and 8 illustrating a third embodiment of the present invention, an ice dispersing unit 200" of the icemaker 100 is fixed to the body 10 and is arranged between the ice making unit 110 and the ice making container 120 of the icemaker 100.

The ice dispersing unit 200" is located close to one side of the ice making unit 110, to transfer the ice falling from the ice making unit 110 into the ice making container 120.

The ice dispersing unit 200" includes a plate-shaped guide member 201" to guide the ice falling from the ice making unit 110 for uniform dispersion of the ice in the ice making container 120, and fixing members 210 to connect the guide member 201" to the body 10 of the refrigerator.

The fixing members 210 may take the form of wires and may be made of an elastic material.

Both ends of each of the fixing members 210 are formed with fixing portions 210*a* to be coupled respectively to an inner upper end of the body 10 and the guide member 201".

Although the present embodiment illustrates the fixing portion 210*a* of the fixing member 210 as taking the form of a hook, other shapes suitable to couple to the body or guide member 201" may be adopted.

The guide member 201" has an arched cross section having a curvature for sliding of the ice and is tilted downwards and towards the front of the ice making container 120.

The guide member 201" is perforated in front and rear ends thereof with coupling holes 213 to couple the respective fixing members 210.

Accordingly, the fixing portion 210*a* formed at a lower end of the fixing member 210 is coupled with the coupling hole 213 of the guide member 201". Although not shown, an upper end of the fixing member 210 is coupled with a fixing recess indented in an upper surface of the body 10 of the refrigerator. In this way, the ice dispersing unit 200" is located between the ice making unit 100 and the ice making container 120.

In this case, the fixing members 210 used to fix the front end of the guide member 201" are longer than the fixing members 210 used to fix the rear end of the guide member 201", such that the guide member 201" is tilted downwards and towards the front of the ice making container 120.

Figure 7:
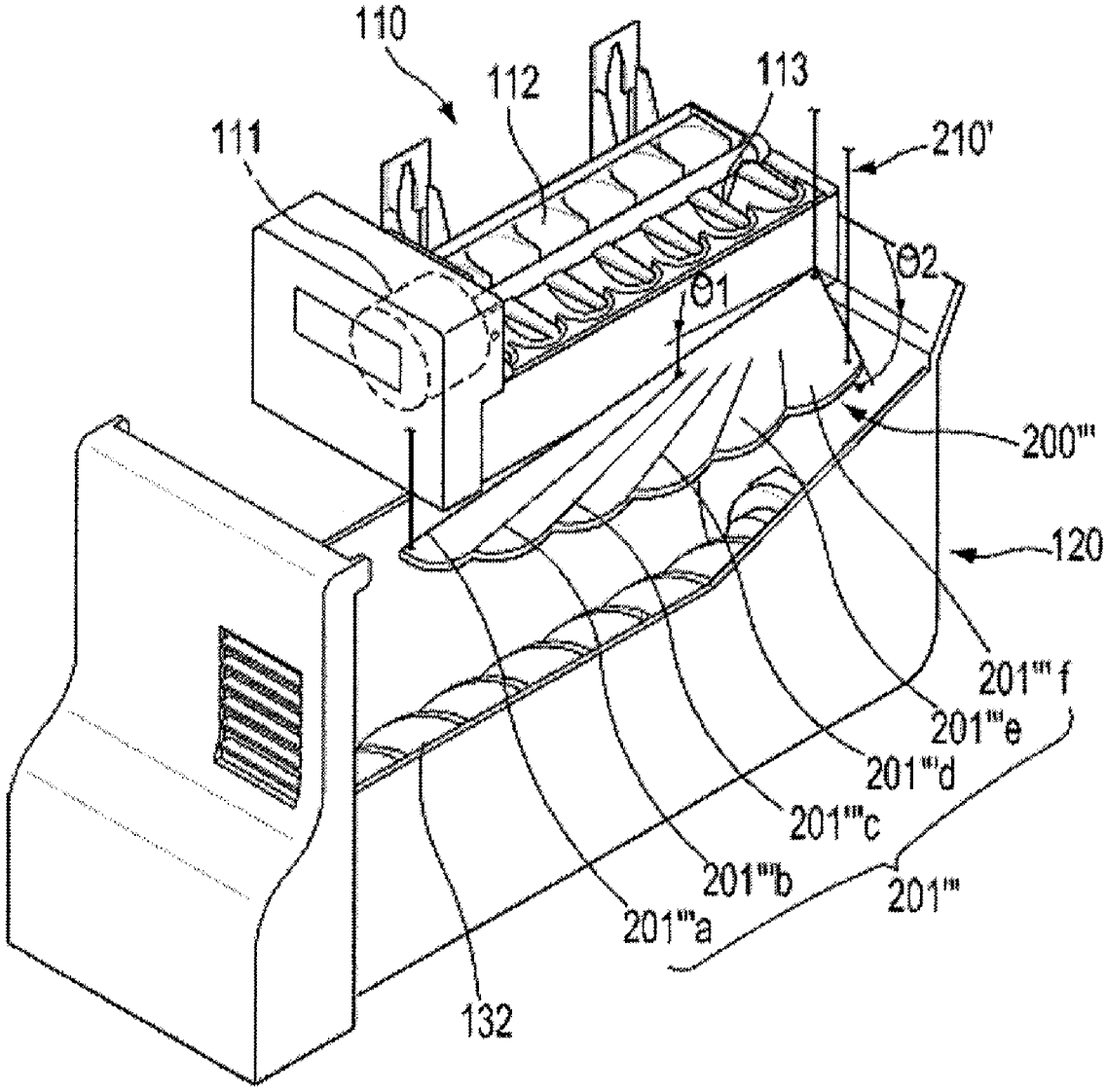
FIG. 7 is a perspective view schematically illustrating an ice dispersing unit according to the third embodiment of the present invention.

In a further embodiment of the present invention, shown in FIG. 7, an ice dispersing unit 200''' includes a plurality of guidelines 201''' having different lengths and directions. As the ice falling from the ice making unit 110 is guided along the guidelines 201''' located at different positions, the ice may be uniformly distributed in the ice making container 120.

In this case, both ends of the ice dispersing unit 200''' are fixed by fixing members 210'. A configuration of the fixing members 210' is identical to the description above, and a detailed description thereof will be omitted.

The fixing members 210' used to fix the ice dispersing unit 200''' are installed such that the fixing members 210' used to fix a front end of the ice dispersing unit 200''' are longer than the fixing members 210' used to fix a rear end of the ice dispersing unit 200''' and consequently, the ice dispersing unit 200''' is tilted downwards and towards a front thereof. In addition, of the fixing members 210' used to fix the rear end of the ice dispersing unit 200''', the outer fixing member 210' is longer than the inner fixing member 210'. Thereby, the ice dispersing unit 200''' is tilted downwards and towards a front end thereof and simultaneously, is tilted downwards and towards an outer end thereof.

Accordingly, the ice dispersing unit 200''' including the guidelines 201''' is tilted downwards and toward a front end thereof by a predetermined angle $\theta_1$, and also, is tilted downwards and towards an outer end thereof by a predetermined angle $\theta_3$. With this configuration, the ice falling from the ice making unit 110 is uniformly dispersed into the ice making container 120 along the guidelines 201'''*a*-201'''*f* located at different positions so as to be received in the entire ice making container 120.

As is apparent from the above description, an icemaker of a refrigerator according to the embodiments of the present invention includes an ice dispersing unit to achieve uniform distribution of ice in an ice making container.

The uniform distribution of ice in the ice making container may not only achieve enhanced utilization of the entire ice making container, but also achieve an increased storage amount of ice.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body defining an external appearance of the refrigerator;

a storage compartment formed in the body and having an open side;

a door to open and close the open side of the storage compartment;

an ice making unit provided in the storage compartment, the ice making unit including an ice making tray having cavities to receive water therein, the water in the ice making tray being frozen into ice pieces by cold air;

an ice container to receive the ice pieces; and a guide member arranged between the ice making unit and the ice container, the guide member including a mounting portion, a free end portion and a sloped portion between the mounting portion and the free end portion, wherein the sloped portion is sloped in both a longitudinal direction and a lateral direction of the ice making tray, and at least a portion of the guide member is tilted in a downward direction substantially perpendicular to the mounting portion and is further tilted in a downward direction substantially parallel to the mounting portion.

2. The refrigerator according to claim 1, wherein the guide member further has a curved guide surface.

3. The refrigerator according to claim 1, wherein the guide member has a plurality of travel paths for the ice pieces separated from respective cavities of the ice making tray, each of the travel paths having a slope different from a slope of the other travel paths.

4. The refrigerator according to claim 1, wherein the guide member is configured to provide a travel path along the sloped portion to enable one of the ice pieces from the ice making unit to move in a diagonal direction with respect to the ice making tray.

5. The refrigerator according to claim 1, wherein the guide member is located adjacent to one side of the ice making unit to transfer the ice separated from the ice making unit into the ice container.

6. The refrigerator according to claim 1, wherein at least a portion of the guide member is tilted in a downward direction towards a front end thereof and is further tilted in a downward direction towards an outer end thereof.

7. The refrigerator according to claim 1, wherein the guide member has a plate form comprising an arched cross section suitable to smoothly guide the ice falling from the ice making unit into the ice container.

8. A refrigerator comprising:

a body defining an external appearance of the refrigerator;

a storage compartment formed in the body and having an open side;

a door to open and close the open side of the storage compartment;

an ice making unit provided in the storage compartment, the ice making unit including an ice making tray having cavities to receive water therein, the water in the ice making tray being frozen into ice pieces by cold air;

an ice container to receive the ice pieces; and a guide member arranged between the ice making unit and the ice container, the guide member including a mounting portion, a free end portion and a sloped portion between the mounting portion and the free end portion, wherein the sloped portion is sloped in both a longitudinal direction and a lateral direction of the ice making tray, at least a portion of the guide member is tilted in a downward direction towards a front end thereof and is further tilted in a downward direction towards an outer end thereof, the portion of the guide member is tilted in the downward direction towards the front end thereof by a predetermined angle $\theta_1$, and is also tilted downwards and towards an outer end thereof by a predetermined angle $\theta_2$.

9. The refrigerator according to claim 8, wherein the guide member further has a curved guide surface.

10. The refrigerator according to claim 8, wherein the guide member has a plurality of travel paths for the ice pieces separated from respective cavities of the ice making tray, each of the travel paths having a slope different from a slope of the other travel paths.

11. The refrigerator according to claim 8, wherein the guide member is configured to provide a travel path along the sloped portion to enable one of the ice pieces from the ice making unit to move in a diagonal direction with respect to the ice making tray.

12. The refrigerator according to claim 8, wherein the guide member is located adjacent to one side of the ice making unit to transfer the ice separated from the ice making unit into the ice container.

13. The refrigerator according to claim 8, wherein at least a portion of the guide member is tilted in a downward direction towards a front end thereof and is further tilted in a downward direction towards an outer end thereof.

14. The refrigerator according to claim 8, wherein the guide member has a plate form comprising an arched cross section suitable to smoothly guide the ice falling from the ice making unit into the ice container.

15. A refrigerator comprising:

a body defining an external appearance of the refrigerator;

a storage compartment formed in the body and having an open side;

a door to open and close the open side of the storage compartment;

an ice making unit provided in the storage compartment, the ice making unit including an ice making tray having cavities to receive water therein, the water in the ice making tray being frozen into ice pieces by cold air;

an ice container to receive the ice pieces; and a guide member arranged between the ice making unit and the ice container, the guide member including a mounting portion, a free end portion and a sloped portion between the mounting portion and the free end portion, wherein the sloped portion is sloped in both a longitudinal direction and a lateral direction of the ice making tray, at least a portion of the guide member is tilted in a downward direction substantially perpendicular to the mounting portion and is further tilted in a downward direction substantially parallel to the mounting portion, and the mounting portion of the guide member is located higher than a free end of the guide member such that the ice falling from the ice making unit may slide along the tilted guide member.

16. The refrigerator according to claim 15, wherein the guide member further has a curved guide surface.

17. The refrigerator according to claim 15, wherein the guide member has a plurality of travel paths for the ice pieces separated from respective cavities of the ice making tray, each of the travel paths having a slope different from a slope of the other travel paths.

18. The refrigerator according to claim 15, wherein the guide member is configured to provide a travel path along the sloped portion to enable one of the ice pieces from the ice making unit to move in a diagonal direction with respect to the ice making tray.

19. The refrigerator according to claim 15, wherein the guide member is located adjacent to one side of the ice making unit to transfer the ice separated from the ice making unit into the ice container.

20. The refrigerator according to claim 15, wherein at least a portion of the guide member is tilted in a downward direction towards a front end thereof and is further tilted in a downward direction towards an outer end thereof.

* * * * *